US006832818B2

(12) United States Patent
Luciano

(10) Patent No.: US 6,832,818 B2
(45) Date of Patent: Dec. 21, 2004

(54) MILLING DRUM FOR ROAD WORKING MACHINE

(75) Inventor: Gelai Luciano, Cornedo Vicentino (IT)

(73) Assignee: Bitelli S.P.A. (IT)

( * ) Notice: Subject to any disclaimer, the term of this patent is extended or adjusted under 35 U.S.C. 154(b) by 0 days.

(21) Appl. No.: 10/460,854

(22) Filed: Jun. 13, 2003

(65) Prior Publication Data

US 2004/0051369 A1 Mar. 18, 2004

(30) Foreign Application Priority Data

Jun. 19, 2002 (EP) ..... 02013620

(51) Int. Cl.[7] ..... E21C 23/88
(52) U.S. Cl. ..... 299/39.8; 299/106; 299/87.1
(58) Field of Search ..... 299/106, 107, 299/102, 87.1, 79.1, 39.8

(56) References Cited

U.S. PATENT DOCUMENTS 4,542,943 A 9/1985 Montgomery
4,650,254 A 3/1987 Wechner
5,842,747 A * 12/1998 Winchester ..... 299/87.1
5,884,979 A * 3/1999 Latham ..... 299/106
6,386,641 B2 * 5/2002 Mondy ..... 299/79.1

FOREIGN PATENT DOCUMENTS

| | | |
|---|---|---|
| DE | 2855577 | 7/1980 |
| EP | 0771911 | 5/1997 |
| EP | 0875625 | 11/1998 |

* cited by examiner

*Primary Examiner*—John Kreck
(74) *Attorney, Agent, or Firm*—Stephen L Noe

(57) ABSTRACT

A tool mounting device for a milling drum, in particular a fine milling drum, is provided which includes a pedestal portion adapted to be connected to a surface of the milling drum. The pedestal portion has an extension from a side of the milling drum. The extension follows the contour of the milling drum surface, and is adapted to be welded to the drum surface.

12 Claims, 3 Drawing Sheets

Fig. 1.
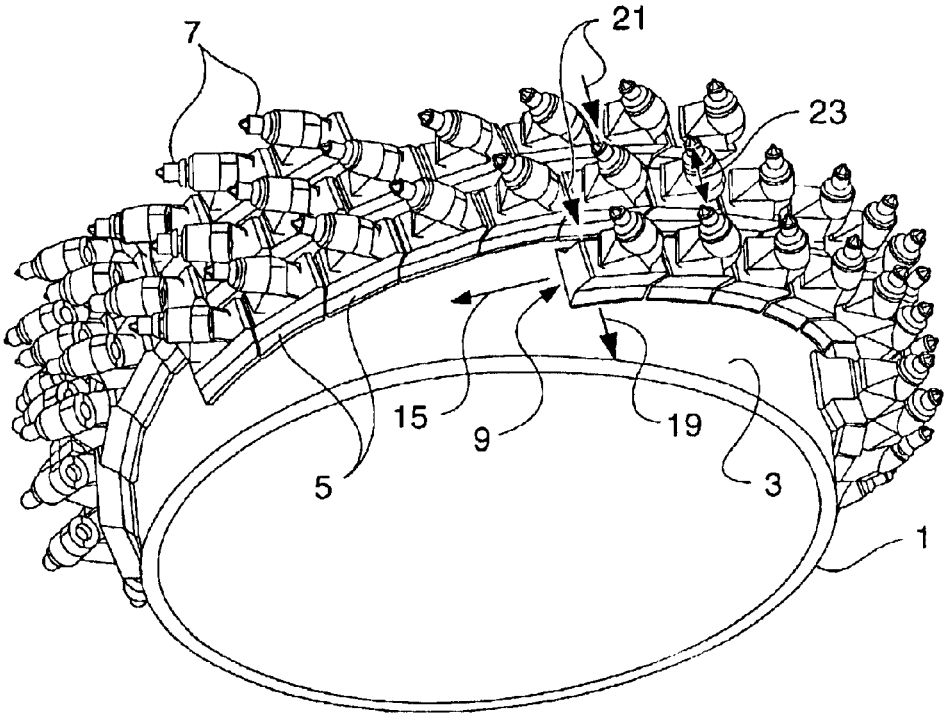
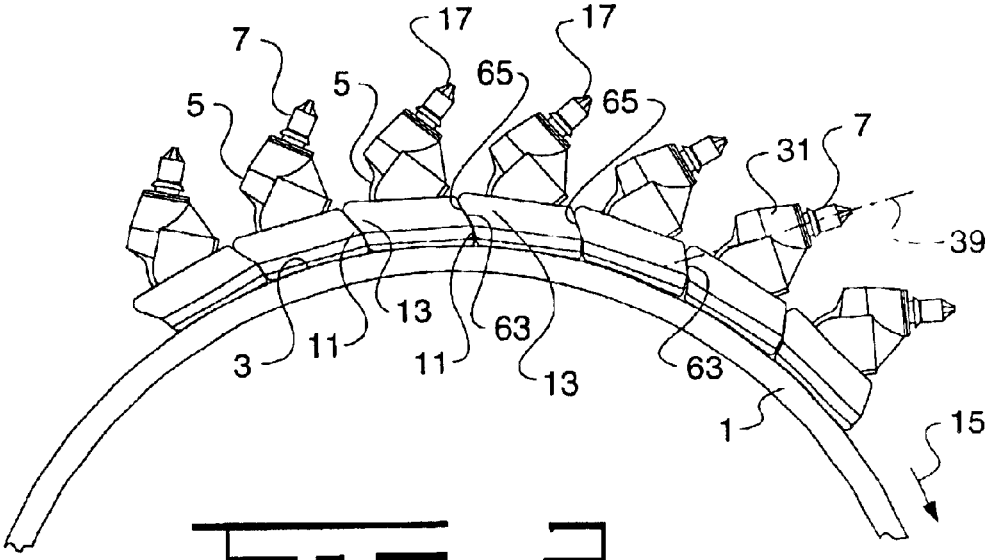
Fig. 2.

MILLING DRUM FOR ROAD WORKING MACHINE

TECHNICAL FIELD

The present invention relates to a milling drum, in particular a fine milling drum of a road working machine, and a method for manufacturing the same. More particularly it relates to a tool mounting device adapted to be mounted to the surface of a milling drum.

BACKGROUND

Scarifiers or cold planers equipped with a milling drum are used for removing soil surfaces, in particular asphalted road surfaces. Tools or picks supported on a surface of the milling drum come into contact with the asphalted surface to be removed during rotation of the milling drum. Depending on the particular choice and on the arrangement of the tools on the surface of the milling drum, the road working machine is adapted to either break up the asphalted surface or to grind it to remove only a damaged layer of the surface. For the latter operation, so called fine milling drums are utilized which are adapted to remove a predetermined thickness of the asphalted surface and to simultaneously finish it so it may remain like it is, or to smooth it for a later finishing operation, e.g. paving a new asphalt layer. To this end, the tools have to be densely and accurately arranged on the milling drum surface. In particular, tip portions of the tools which come into contact with the asphalted surface to grind it off, have to be located at a predetermined uniform distance spaced from the milling drum surface and also positioned at a predetermined angle to the circumferential and axial directions of the milling drum.

The tools supported on the milling drum get worn quickly during operation and have to be serviced or exchanged frequently. To this end, it is known to provide tool mounting devices connected to the surface of the milling drum by welding. The tool mounting devices usually comprise a tool mounting portion adapted to releasably hold a tool and a drum connection portion which is fixed to the milling drum surface by welding. One example of such a device is disclosed in U.S. Pat. No. 4,650,254 issued Mar. 17, 1987, which shows a bit or tool holder having an integral base part arranged to be welded front and rear to a curved milling drum. The tools are spaced apart to provide clearance to reduce dust in mining operations.

For fine milling drums, the tool mounting devices may be provided as an integral part having a base block portion to be welded to the drum surface. For example, one known technique is to weld a toolholder or box adapted to accomodate a milling tool to a base block and then weld the base block to the surface of the milling drum. These types of milling drums are also referred to as the "welded box type" milling drums. Inasmuch the tool mounting devices, i.e. their base blocks, have to be densely arranged on the surface, it is necessary to completely weld each individual base block before a next adjacent base block may be attached to the milling drum surface because the previously attached base block can not be reached by any welding tool afterwards.

The present invention is directed to solve this and other problems of the above described prior art.

SUMMARY OF THE INVENTION

In accordance with one aspect of the invention, a tool mounting device for a milling drum is disclosed that includes at least one pedestal portion adapted to be welded to a surface of the milling drum and having a first extension in a first axial direction of the milling drum from a first longitudinal side surface of the tool mounting device. The pedestal portion is further adapted to engage the surface of the milling drum along essentially the length of the tool mounting device in a circumferential direction of the milling drum. The pedestal portion provides working space for a tool such as a welding tool and, thus, facilitates finish of a weld seam between a tool mounting device and the surface of the milling drum although, in its vicinity, other tool mounting devices are already arranged on the milling drum surface.

In accordance with another aspect of the invention, a method is disclosed for manufacturing a milling drum, in particular a fine milling drum. The method includes the steps of providing tool mounting devices including at least one pedestal portion adapted to be welded to a surface of the milling drum, said pedestal portion having first and second extensions in opposite axial directions of the milling drum from first and second longitudinal side surfaces of the tool mounting devices, said first and second extensions being adapted to engage the surface of the milling drum along essentially the length of the tool mounting devices in a circumferential direction of the milling drum. In a subsequent step the tool mounting devices are arranged in abutting engagement in a circumferential direction of the milling drum and in a manner to form a welding channel by means of the pedestal portions of respective tool mounting devices adjacent in the axial direction of the milling drum. In a following step, the tool mounting devices are welded to the surface of the milling drum along the welding channel formed by said pedestal portions.

BRIEF DESCRIPTION OF THE DRAWINGS

FIG. 1 shows a perspective view of a fine milling drum partially equipped with tool mounting devices in accordance with an embodiment of the present invention;

FIG. 2 shows a side view of a portion of the fine milling drum of FIG. 1;

DETAILED DESCRIPTION

Figure 3:
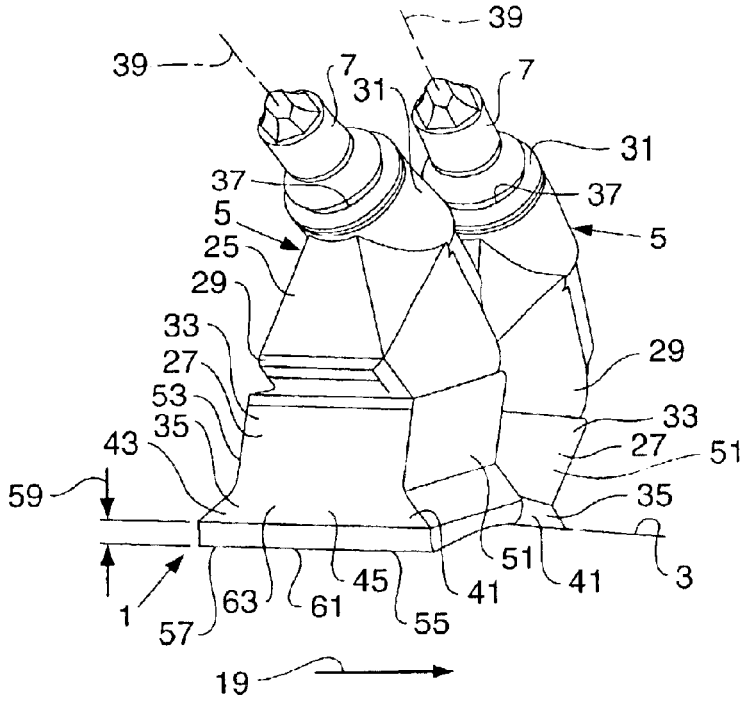
FIG. 3 is a perspective view of two adjoining tool mounting devices shown in FIG. 1.

According to FIG. 1, tool mounting devices 5 holding respective tools 7 are arranged in a spiral configuration 9 on a surface 3 of a milling drum 1.

As better seen in FIG. 2, the tool mounting devices 5 are arranged in abutting engagement with a front side 11 of a respective tool mounting device 5 adjacent to a rear side 13 of another tool mounting device 5 which is similarly shaped and positioned in front with respect to a circumferential direction 15 of the milling drum 1. Tool tips 17 of the tools 7 are generally facing in the circumferential direction 15. FIG. 1 further shows, that in a general axial direction 19 of the milling drum 1, the tool holder mounting devices 5 arranged along the spiral configuration 9 are spaced from each other by a gap 21. The distance 23 between adjacent tool tips 17 in the general axial direction 19 is defined by the pitch of the spiral configuration 9.

FIG. 3 shows a preferred embodiment of two adjacent tool mounting devices 5 with respective tools 7 in a perspective front view. The tool mounting devices 5 comprise a toolholder block 25 adapted to support a respective tool 7 and a base block 27 adapted to be connected to the surface 3 of the milling drum 1.

The toolholder block 25 has a connection portion 29 adapted to be connected to the base block 27 and a tool mounting portion 31 adapted to receive and hold a respective tool 7. The base block 27 comprises a toolholder mounting portion 33 and a drum mounting portion 35. The toolholder block 25 and the base block 27 are fixedly connected by welding the connection portion 29 and the toolholder mounting portion 33 to each other.

In the embodiment shown, the tool mounting portion 31 has a generally tubular configuration and receives the tool 7 in a through hole 37 with an axis 39 of the through hole 37 defining the general angular orientation of the tool 7 with respect to a tangential plane of the milling drum 1. The connection portion 29 is shaped to take up the forces applied by the tool 7 during operation and to direct reaction forces through the base block 27 towards the milling drum 1. The particular shape of the toolholder block 25 may vary in accordance with specific requirements of the particular application, e.g. with the choice of the specific tools to be supported by the toolholder block 25. Also, the toolholder block 25 and the base block 27 may be formed as one part integrally manufactured as a whole.

As further seen in FIG. 3, the drum mounting portion 35 of the base block 27 comprises a first and a second extension 41, 43 forming a pedestal portion 45. The term "pedestal portion" is intended to illustrate an extended or widened portion of the base block 27 or the tool mounting device 5, which protrudes from the general outline of the tool mounting device 5.

The first extension 41 of the pedestal portion 45 extends in the generally axial direction 19 outwardly from a first longitudinal side surface 51 of the base block 27 more or less defining the general side extension of the tool mounting device 5. Similarly, the second extension 43 extends in a direction opposite to the generally axial direction 19 outwardly from a second longitudinal side surface 53 opposite to the first longitudinal side surface 51 and also more or less defining the general side extension of the tool mounting device 5 on this respective side. The longitudinal side surfaces 51, 53 extend substantially straight in a radial direction with respect to the milling drum 1 and the toolholder block 33 mounted on top of the base block 35 does not significantly protrude outwardly therefrom.

Figure 4:
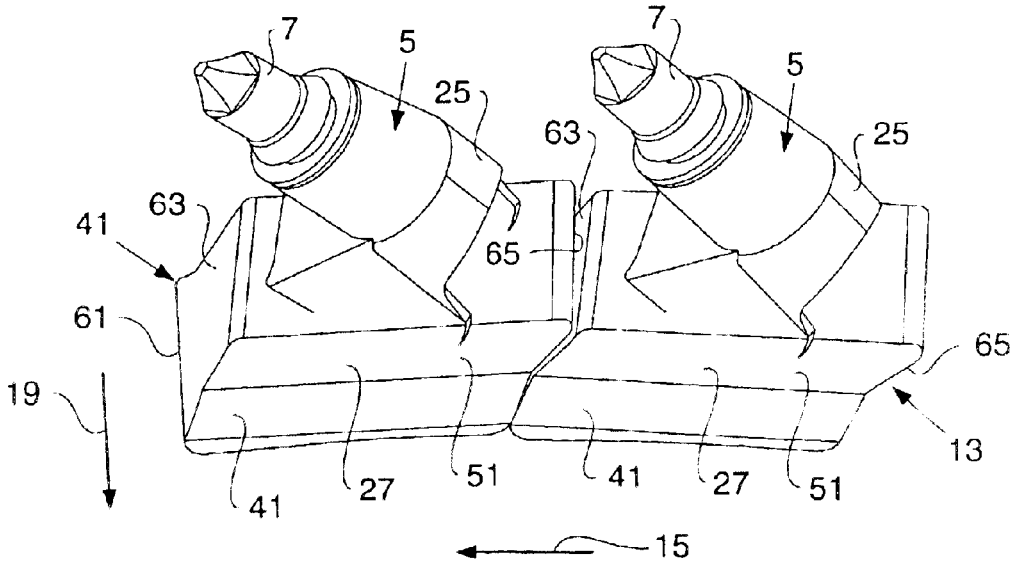
FIG. 4 is another perspective view of two adjoining tool mounting devices shown in FIG. 1.

The first and second extensions 41 and 43 are provided along essentially the whole length of the base block 27 in the circumferential direction 15 (see FIG. 4). They comprise lower surfaces 55, 57 formed so as to essentially completely engage the surface 3 of the milling drum, when the tool mounting device 5 is placed on the milling drum 1. Preferably, they have a height 59 corresponding to the height of a weld seam (not shown) to be applied to the drum connection portion 35 to connect the tool mounting device 5 to the milling drum 1. In the preferred embodiment, the extensions 41, 43 are, in an axial cross section, substantially wedge shaped and tapered outwardly wherein the height 59 is provided at the outer extremeties of the extensions 41, 43. In the generally axial direction 19, the extent of the pedestal 45 is sufficient so as to provide space in the axial direction for a tool, such as a welding tool, which will be explained in more detail below. Preferably, the lower surfaces 55, 57 of the pedestal portion 45 are parts of a drum mounting surface 61 of the tool mounting device 5 adapted to engage the surface 3 of the milling drum 1.

As better seen in the top perspective view of FIG. 4, the base block 27 has an inclined front surface 63 on the front side 11 of the tool mounting device 5 and a inclined rear surface 65 on the rear side 13 of the the tool mounting device 5. The front surface 63 is inclined at an acute angle with respect to the drum mounting surface 61. The rear surface 65 is inclined at an obtuse angle with respect to the drum mounting surface 61 and is substantially parallel to the front surface 63. In the abutting arrangement of two tool mounting devices S shown in FIG. 4, the front surface 63 bears from below against the rear surface 65.

INDUSTRIAL APPLICABILITY

Figure 5:
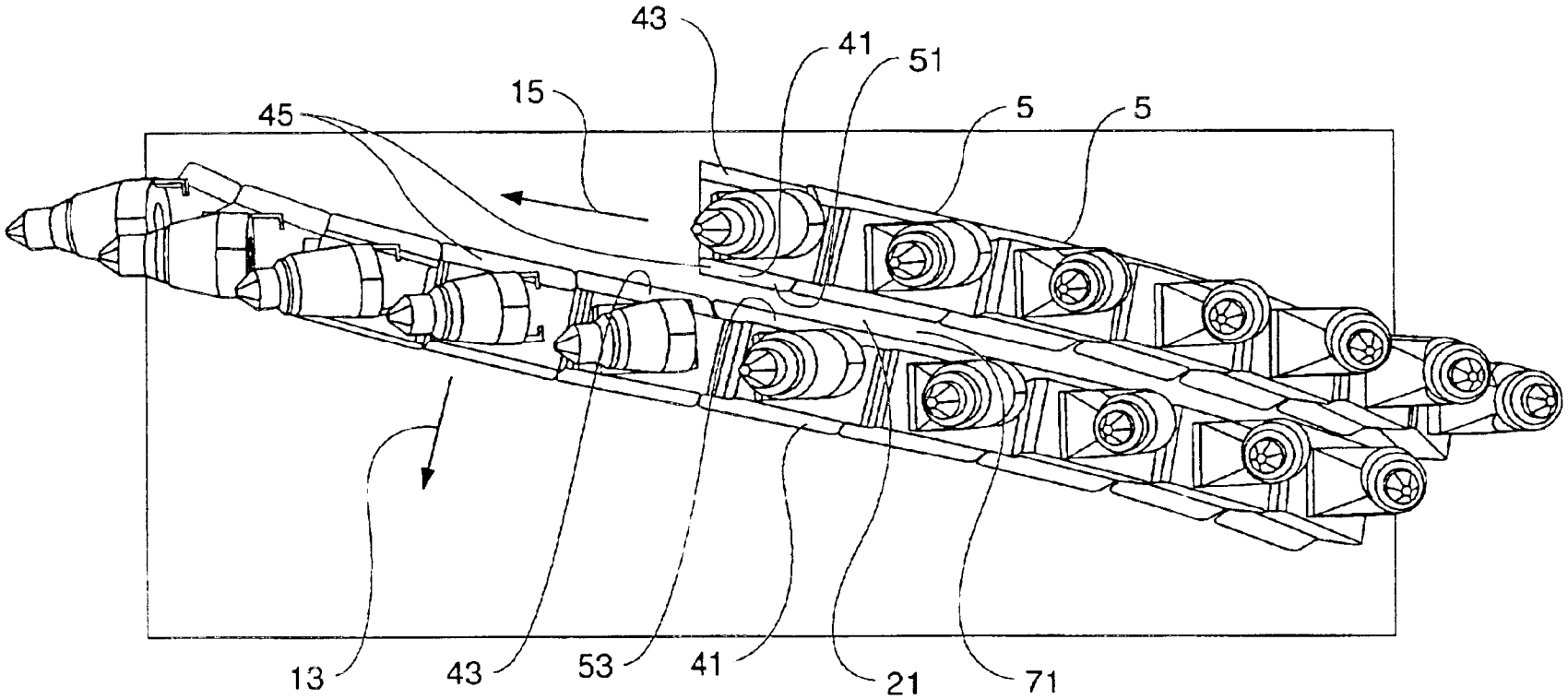
FIG. 5 is a perspective view of a portion of the milling drum of FIG. 1 showing two adjacent spiral portions of a tool mounting device configuration.

With reference to FIG. 5, the fine milling drum 1 is equipped with tool mounting devices 5 described above by first arranging the the tool mounting devices 5 in abutting engagement generally along the circumferential direction 15. In generally the axial direction 19 of the milling drum 1, the longitudinal side surfaces 51, 53 of adjacent tool mounting devices 5 are spaced apart by the gap 21 which is wide enough so as to permit access with a tool, e.g. a welding tool. In the area of the pedestal portions 45 of axially adjacent tool mounting devices 5 the gap 21 becomes more narrow and is defined by a distance between the outer extremeties of the extensions 41, 43. In other words, the extensions 41, 43 of the pedestal portions 45 of axially adjacent tool mounting devices form a welding channel 71.

The tool mounting devices 5 are firstly all arranged on the surface 3 of the milling drum 1 so as to obtain the desired final configuration, e.g. at least a spiral configuration as the spiral 9 shown in FIG. 1. Another final configuration may be preferred depending on the field of application of the fine milling drum 1. Preferably the tool mounting devices 5 are placed by means of a computer aided placing device (not shown) which facilitates accurate positioning and orientation of the tool mounting devices 5. Then they are preliminary attached to the surface 3 by, for example, tack welds. After all desired tool mounting devices have been positioned on the surface 3 completely, they are fixedly attached by welding along the welding channel 71 formed by the pedestal portions 45 of the tool mounting devices 5. Thus, advantageously, there is only one weld needed to attach two axially adjacent tool mounting devices 5 to the surface 3. Welding is preferably performed so as to not significantly disturb the positioning of the tool mounting devices 5 by thermal deformations.

Preferably, the tool mounting devices 5 are positioned in a staggered arrangement as indicated in FIG. 5. In other words, in the direction of the welding channel 71, joint sections of the front and rear sides 11, 13 of abutting tool mounting devices are placed approximately opposite to a center portion of the longitudinal side surfaces 51, 53, respectively of an axially adjacent tool mounting device 5. This facilitates a more uniform distribution of distortion forces resulting from thermal deformation of the material of the tool mounting devices 5 during welding.

The gap 21 further is wide enough to allow access with a tool, e.g. a welding tool, to join the tool mounting devices 5 at their respective front and rear sides 11, 13 by weld seams.

Thus, the present invention offers the advantage of facilitating a preliminary accurate positioning of all the necessary tool mounting devices 5 on the surface 5 of the milling drum 1 without the necessity of finishing the weld for each individual tool mounting device 5 simultaneously with the positioning step. In particular, the present invention facilitates the use of a computer aided positioning device to accurately determine the placement of the tool mounting devices in particular for a fine milling drum. The final fixture or weld is only effected after the positioning is completed and may be also performed without detrimentally affecting the accurate arrangement.

Referring to FIG. 2, with the tool mounting device 5 fixed to the surface 3 of the milling drum, during operation of the milling drum the tool 7 exerts a force directed generally along the axis 39. This, in turn, imparts a rotational momentum at the front side 11 of the tool mounting device 5 tending to lift the tool mounting device 5 away from the surface 3 of the milling drum. On the other hand, the force of the tool 7 directed along the axis 39 urges the rear side 13 of an adjoining tool mounting device 5 positioned in front with respect to the circumferential direction 19 towards the surface 3 of the milling drum 1. This force, again, is transmitted by the rear surface 65 abutting the front surface 11 of the tool holder device 5 positioned behind so as to counteract the lifting tendency of the rotational momentum. In other word, the front side 11 of one tool mounting device 5 is locked by the rear side 13 of a next tool mounting device 5 in front of the one tool mounting device 5. This locking function may be realised differently by at least providing a portion on the front side 11 of the tool mounting device 5 adapted to bear against a corresponding portion on the rear side 13 of an adjacent tool mounting device 5 when the rotational momentum with the lifting tendency is exerted on the tool mounting device 5 during operation of the milling drum 1.

In the preferred embodiment, the front and rear surfaces 63, 65 are substantially planar and the base block 27 has thus, in cross section along the circumferential direction 19, a substantial parallelepipedal shape. Inasmuch the front surface 63 is urged in a downward direction towards the milling drum 1 by the rear surface 65, the front side 11 can not be lifted by a rotational momentum on the tool mounting devices 5 in the clockwise direction in FIG. 2. On the other hand, a rotational momentum in the anticlockwise direction tends to lift the rear sides 13 of the tool mounting devices 5 which are not locked by an adjacent tool mounting device. Thus, for maintainance or replacement of one tool mounting device 5 being part of the spiral 9, after disconnecting the welded connections, the tool mounting device 5 may be easily removed from the spiral 9 by rotating it in the anticlockwise direction and thus lifting the rear side 13 and pulling the front side 11 out of the locking position under the rear side 13 of an adjacent tool mounting device 5.

Generally, by the provision of the gap 21 resulting from the pedestal portions 45 and by allowing easy access with a tool for detaching the tool mounting device 5 from the surface 3, e.g. by removing the welded seams, the invention also provides for an easy replacement of tool mounting devices 5 arranged on the surface 3 of a completed milling drum. In the preferred embodiment with the previously described locking feature of the front side 11 of one tool mounting device 5 beneath the rear side 13 of an adjacent tool mounting device 5 an exchange of tool mounting devices 5 on a completed drum 1 is even more simplified.

The invention has been described with reference to a preferred embodiment. However, it is to be understood that variations and modifications to individual features of the described embodiment may be envisioned by one skilled in the art, and are intended to be covered by the scope of the invention which is to be determined by the appended claims.

What is claimed is:

1. A milling drum, in particular a fine milling drum, comprising:

tool mounting devices attached onto a surface of the milling drum in abutting engagement in a circumferential direction of said milling drum, said tool mounting devices each including at least one pedestal portion adapted to be welded to a surface of the milling drum, said pedestal portion having a first extension in a first axial direction of the milling drum from a first longitudinal side surface of the toolholder mounting device and being adapted to engage the surface of the milling drum along essentially the length of toolholder mounting device in a circumferential direction of the milling drum, and a second extension in a second axial direction from a second longitudinal side surface of the respective toolholder mounting device opposite to the first longitudinal side surface and being adapted to engage the surface of the milling drum along essentially the length of the toolholder mounting device in the circumferential direction, and wherein the pedestal portions of respective tool mounting devices located adjacent one another in the axial direction of the milling drum form a welding channel.

2. The milling drum of claim 1, wherein said pedestal portion extensions forming said welding channel are positioned and configured to be closed with a single weld.

3. The milling drum of claim 2, wherein the tool mounting devices are arranged in at least one spiral configuration on the surface of the milling drum.

4. The milling drum of claim 2, wherein the first and second extensions have a height corresponding to a height of a weld attaching the toolholder mounting device to the surface of the milling drum.

5. The milling drum of claim 1, wherein said tool mounting devices include a front surface with respect to the circumferential direction of the milling drum and inclined at an acute angle with respect to a drum mounting surface of the respective tool mounting device and adapted to bear against a rear surface with respect to the circumferential direction of the milling drum and inclined at an obtuse angle with respect to the drum mounting surface of an adjacent tool mounting device positioned circumferentially in front of the tool mounting device.

6. A base block for mounting a toolholder on a milling drum, comprising:

at least one pedestal portion adapted to be welded to a surface of the milling drum, said pedestal portion having a first extension in a first axial direction of the milling drum from a first longitudinal side surface of the base block and being adapted to engage the surface of the milling drum along essentially the length of the base block in a circumferential direction of the milling drum, and a second extension in a second axial direction from a second longitudinal side surface of the base block opposite to the first longitudinal side surface, said second extension being adapted to engage the surface of the milling drum along essentially the length of the base block, said first and second extensions having a height corresponding to a height of a weld attaching the base block to the surface of the milling drum, and wherein the pedestal portions of respective tool mounting devices located adjacent one another in the axial direction of the milling drum form a welding channel adapted to be closed with a single weld.

7. The base block of claim 6, wherein the first and second extensions are essentially wedge shaped in an axial cross section.

8. The base block of claim 6, including a front surface with respect to the circumferential direction of the milling drum and inclined at an acute angle with respect to a drum mounting surface of the base block and adapted to bear against a rear surface with respect to the circumferential direction of the milling drum and inclined at an obtuse angle with respect to the drum mounting surface of an adjacent equally shaped base block being positioned circumferentially in front of the one base block.

9. A method for manufacturing a milling drum, in particular a fine milling drum, comprising the steps of:

a) providing tool mounting devices which include at least one pedestal portion adapted to be welded to a surface of the milling drum, said pedestal portion having first and second extensions in opposite axial directions of the milling drum from first and second longitudinal side surfaces of the tool mounting devices, said first and second extensions being adapted to engage the surface of the milling drum along essentially the length of the tool mounting devices in a circumferential direction of the milling drum;

b) arranging the tool mounting devices in abutting engagement in a circumferential direction of the milling drum and in a manner to form a welding channel by said pedestal portions of respective tool mounting devices located adjacent one another in the axial direction of the milling drum;

c) welding the tool mounting devices to the surface of the milling drum along said welding channel formed by said pedestal portion extensions with a single weld between axially adjacent extensions.

10. The method of claim 9, wherein said step of arranging the tool mounting devices includes forming at least one spiral shaped arrangement of the tool mounting devices on the surface of the milling drum.

11. The method of claim 10, wherein said step of arranging the tool mounting devices includes using a computer aided positioning device to determine the placement of the tool mounting devices on a milling drum.

12. The method of claim 9, wherein said tool mounting devices include a front surface with respect to the circumferential direction of the milling drum and inclined at an acute angle with respect to a drum mounting surface of the respective tool mounting device and adapted to bear against a rear surface with respect to the circumferential direction of the milling drum and inclined at an obtuse angle with respect to the drum mounting surface of an adjacent tool mounting device positioned circumferentially in front of the tool mounting device.

* * * * *